US006050412A

United States Patent [19]

Clough et al.

[11] Patent Number: 6,050,412

[45] Date of Patent: Apr. 18, 2000

[54] METHOD AND APPARATUS FOR PACKAGING AND SHIPPING HORTICULTURAL PRODUCTS INCLUDING CUT FLOWERS

[75] Inventors: Graham Swallow Clough, Wokingham, United Kingdom; Richard Mark Roger Ingleton, Salinas, Calif.; John Vanderstoep, Vancouver, Canada

[73] Assignee: The SunBlush Technologies Corporation, Toronto, Canada

[21] Appl. No.: 09/133,213

[22] Filed: Aug. 13, 1998

[51] Int. Cl.[7] ..... A01G 5/00

[52] U.S. Cl. ..... 206/423; 229/5.84; 229/939

[58] Field of Search ..... 229/939, 5.81, 229/5.84; 206/423; 47/66, 84

[56] References Cited

U.S. PATENT DOCUMENTS

| | | | |
|---|---|---|---|
| 3,450,542 | 6/1969 | Badran . | |
| 3,450,544 | 6/1969 | Badran et al. . | |
| 3,630,759 | 12/1971 | Rumberger . | |
| 3,798,333 | 3/1974 | Cummin et al. . | |
| 4,170,301 | 10/1979 | Ancil et al. . | |
| 5,029,708 | 7/1991 | Alonso et al. . | |
| 5,217,117 | 6/1993 | Tsuji . | |
| 5,224,598 | 7/1993 | Angeles et al. . | |
| 5,379,549 | 1/1995 | Carcich et al. | 206/423 X |
| 5,575,418 | 11/1996 | Wu et al. . | |
| 5,666,763 | 9/1997 | Kao | 206/423 |

FOREIGN PATENT DOCUMENTS 2266439 11/1993 United Kingdom .

OTHER PUBLICATIONS

C.A. Eaves, A Modified–Atmosphere System for Packages of Stored Fruit, J. Hort. Sci. 37:110, 1960.

R.G. Tomkins, The Conditions Produced in Film Packages by Fresh Fruits and Vegetables and the Effect of These Conditions on Storage Life, J. Appl. Bact. 25(2):290, 1962.

*Primary Examiner*—Jacob K. Ackun

*Attorney, Agent, or Firm*—Oyen Wiggs Green & Mutala

[57] ABSTRACT

This invention relates to a novel method and apparatus for packaging and shipping horticultural products including cut flowers. More particularly, this invention pertains to a novel method of and packaging for packaging cut flowers in a modified atmosphere package to prolong shelf life, shipping the packaged flowers to the destination, and then at the destination, opening the package and rehydrating the cut flowers in the package by saturating the stems of the flowers with water.

14 Claims, 8 Drawing Sheets

FIG. 1
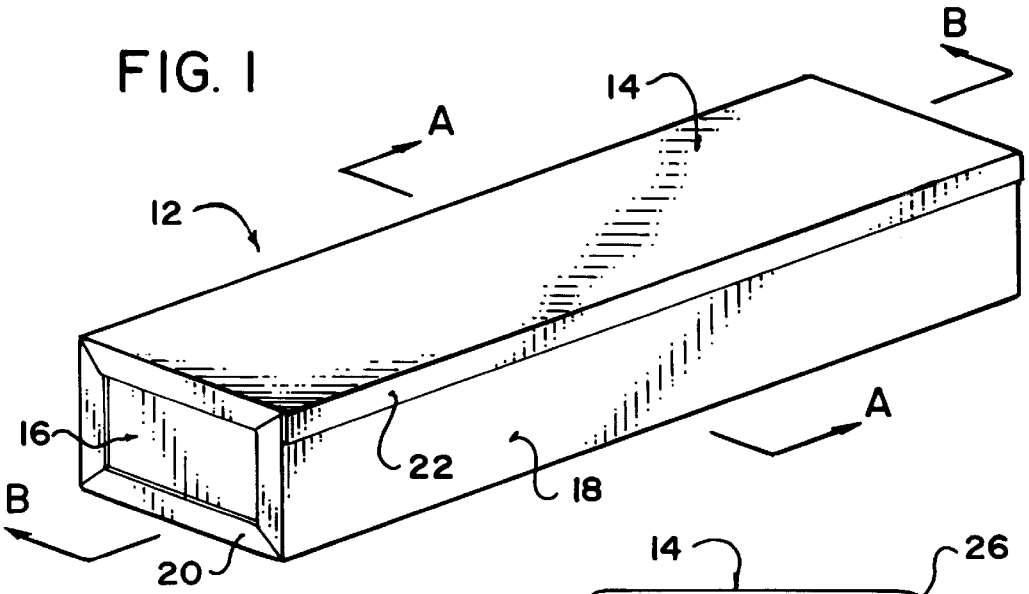
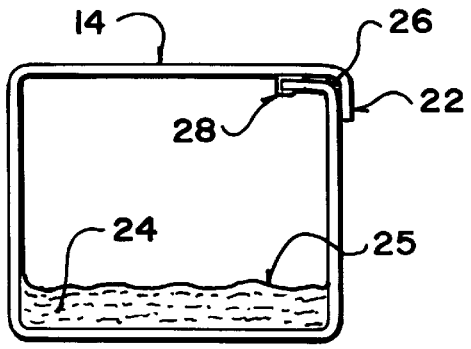
FIG. 3
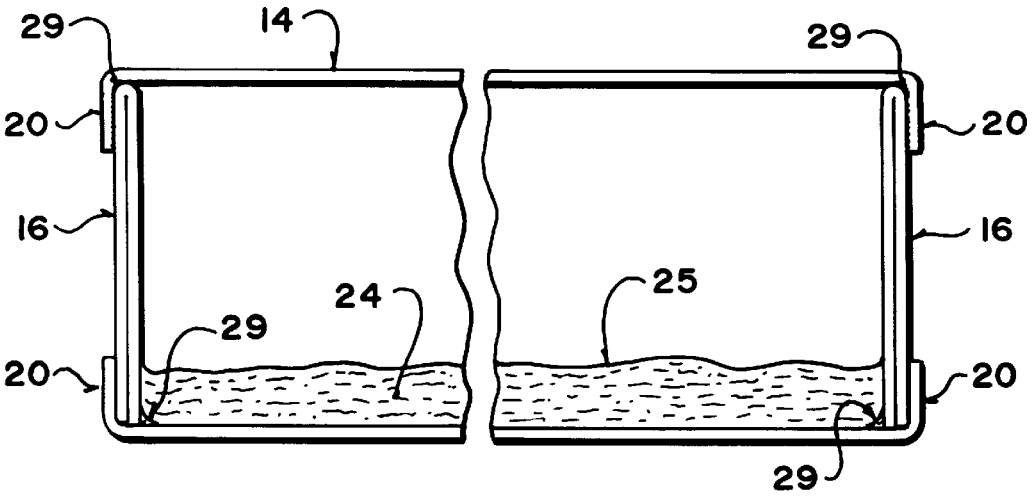
FIG. 4

METHOD AND APPARATUS FOR PACKAGING AND SHIPPING HORTICULTURAL PRODUCTS INCLUDING CUT FLOWERS

FIELD OF THE INVENTION

This invention relates to a novel method and apparatus for packaging and shipping fruits, vegetables, and horticultural products including cut flowers. More particularly, this invention pertains to a novel method of packaging fruits, vegetables, and horticultural products including cut flowers in a modified atmosphere package to prolong shelf life, shipping the packaged products to the destination, and then at the destination, opening the package. In the case of flowers, the cut flowers are rehydrated in the package by saturating the stems of the flowers with water.

BACKGROUND OF THE INVENTION

The fresh picked or harvested quality attributes of harvested fresh fruits, vegetables and horticultural products such as cut flowers must be maintained as much as possible for as long as possible to ensure consumer acceptability. Quality deterioration of harvested fresh fruits, vegetables and horticultural produce is caused by plant tissue enzyme reactions including respiration, ripening and senescence, through microbial growth and through water loss from the plant tissue. Methods of inhibiting the deteriorative enzyme reactions, and the growth of yeasts, molds and bacteria include the reduction of the produce temperature to between 1° and 12° C., and the creation of a low $O_2$/high $CO_2$ modified atmosphere (MA) around the produce. Water in fruits and vegetables can be lost readily under low relative humidity conditions with the consequential detrimental result of skin wrinkling, wilting and reduction in crispness. The rate of water loss from fresh produce can be restricted by storing the produce in closed package systems consisting of walls with low moisture permeability.

Modified atmosphere packaging (MAP) of fruits, vegetables and horticultural products is a process involving:

(1) Performing required pre-packaging conditions and treatment of the produce;

(2) Packing the produce in a gas-permeable package system;

(3) Introducing a gas comprising a predetermined ratio of $CO_2$ and $O_2$ into the headspace of the package system to create a modified atmosphere, or retaining existing air in the headspace of the package system; and (4) Closing and sealing the modified atmosphere package (MAP) system.

During storage of the MAP system, the fruits, vegetables and horticultural products convert $O_2$ from the headspace to $CO_2$ through the natural respiration process of the produce with the result that the $O_2$ content in the headspace decreases while the $CO_2$ content increases. An effective MAP package system for fresh produce regulates the influx of $O_2$ relative to the efflux of $CO_2$ from the package headspace to achieve and maintain a suitable modified atmosphere equilibrium in the headspace around the stored produce. This establishes an optimum environment for retention of the quality attributes of the fresh produce and reduction of detrimental microbial growth in the produce.

While properly controlled low $O_2$ levels and elevated $CO_2$ levels in the headspace around a fresh fruit, vegetable or horticultural commodity reduce the respiration and ripening rates of the fresh produce, and the growth of spoilage organisms (spoilogens), unsuitable modified atmospheres enveloping the produce in a package system can induce physiological damage to the fresh produce, prevent wound healing, enhance senescence and cause off-flavour formation of the produce. Oxygen levels of about 1% can suppress the development of spoilogens. Carbon dioxide levels of 5% or more can suppress the development of spoilogens. $O_2$ levels lower than 1% bring about anaerobic respiration and off-flavour development, whereas $CO_2$ levels of about 10% or higher inhibit spoilogen growth but, on the downside, may cause tissue damage to $CO_2$-sensitive commodities.

Package systems for MAP must be carefully designed and constructed from specific packaging materials to meet the following requirements:

(1) Maintain definitive beneficial equilibrium levels of $CO_2$ and $O_2$ in the headspace within the package;

(2) Obviate gas pressure build-up within the package system;

(3) Minimize moisture loss from produce held in the package system;

(4) Prevent produce crushing and bruising; and (5) Maintain structural strength of the walls of the package system by inhibiting water migration from the interior of the package into the walls of the package system.

Corrugated paperboard boxes and cartons are used commercially for the storage and transport of fresh fruits, vegetables and horticultural commodities. Advantages of corrugated paperboard boxes and cartons are relatively low cost per unit volume, low thermal energy wall conductivity, impact absorbing ability to prevent bruising of the packaged commodities and ease of disposal of the used package at the receiving end. However, conventional corrugated paperboard has a very high gas and moisture permeability and as such is unsuitable for modified atmosphere packaging of fresh fruits, vegetables and horticultural commodities.

Since gas and moisture permeabilities of package components of MAP systems are critical parameters, conventional corrugated paperboard has been modified to include gas and moisture controlling polymer films. Plastic polymeric films have been developed so that a specific gas permeability requirement can be met with a single plastic film or a multifilm combination, with or without vent pinholes.

In 1960, Eaves (J. Hort. Sci. 37:110, 1960) reported the use of gas-permeable, flexible polymeric barrier film as a package system for extending the life of fresh commodities. Tomkins (J. Appl. Bacteriol. 25:290, 1962) used polymeric film-covered trays to determine their effectiveness in establishing equilibrium MA around apples. Prior art on the use of bags made from polymeric gas permeable films such as polyethylene and polyvinylchloride for prolonging of shelf-life of stored fruits and vegetables, is exemplified by U.S. Pat. No. 3,450,542, Badran, U.S. Pat. No. 3,450,544, Badran et al., and U.S. Pat. No. 3,798,333, Cummin. A more complex package system has been described by Rumberger in U.S. Pat. No. 3,630,759. There, an inner plastic pouch containing the produce is enveloped by an outer pouch containing an atmosphere of less than 15% $O_2$. Both pouches are to be constructed from gas-permeable films.

U.S. Pat. No. 5,575,418, granted Nov. 19, 1996, Wu et al., discloses an invention relating to novel package systems for refrigerated modified atmosphere packaging of fresh fruit, vegetables and cut flowers. More particularly, the invention relates to the design, construction, closure, sealing and use of gas-permeable corrugated paperboard package systems for prolonging the storage life of fresh fruits, vegetables and cut flowers under modified atmosphere in the headspaces of the closed package system. The patent discloses a corrugated gas permeable paperboard comprising: (a) a first layer of Kraft paper; (b) a layer of polymer having a gas permeability which permits gas to be transmitted through the polymeric film at prescribed levels; (c) a second layer of Kraft paper, said first and second layers of Kraft paper sandwiching the polymer between them; (d) a corrugated fluting; and (e) a third layer of Kraft paper affixed to the corrugated fluting.

It has been noted from many field trials that distribution chains currently used for fruit and vegetable produce and horticultural products such as cut flowers do not necessarily provide adequate temperature control to ensure optimum produce and flower shelf life. Pallets and/or boxes stored at points along the distribution chain can be subject to unacceptable temperature rise causing the contents to increase their respiration rate, thereby leading to a shortening of the life of the fresh produce and flowers, both in terms of microbiological activity and sensory quality. Furthermore, when the MA package is subjected to a rise in temperature, the gas permeability rate of the polymer lining in the package will increase and thus allow higher levels of oxygen into the box. This promotes rapid decay of the fresh produce or cut flowers. There is therefore a strong need in the fresh produce or flower packaging and distribution industry for a MAP that will not only protect the fresh produce by controlling gas transmission rate into and out of the package but also provide temperature abuse resistance. Cut flowers generally have low respiration rates so the natural build up of respiration heat inside the MA box is minimal. The box is more likely to pick up heat from the surrounding conditions. The need to provide thermal protection is particularly important where fresh vegetable and fruit commodities are air freighted since the aircraft and airport apron handling operations are rarely temperature controlled. In certain parts of the world, for instance, it is common for MAP loaded pallets to sit in tropical conditions for hours waiting for the aircraft to be loaded.

SUMMARY OF INVENTION

This invention relates to a method and apparatus for packaging and shipping fresh fruit, vegetable and horticultural products including cut flowers to provide temperature abuse resistance. This invention also pertains to a development of the MAP system directed specifically to the flower and horticulture products industry. In the latter case, the invention is directed to a corrugated paperboard package suitable for holding water, treatment solutions, polymer gels or moist soil compositions (compost) specifically for the purpose of rehydrating or retaining moisture in flowers, foliage, nursery plants and potted plants.

The invention pertains to a method of transporting horticultural products from a first location to a second location characterized by: (a) packaging the horticultural product in a waterproof package containing a modified atmosphere at a first location; (b) transporting the modified atmosphere packaged horticultural product from the first location to a second location; (c) opening the package of the horticultural product and adding water to the package to rehydrate the horticultural product.

The modified atmosphere in the package can comprise a mixture of carbon dioxide and oxygen. The gas permeability of the walls of the modified atmosphere package can be between about 50 and about 50,000 $cc^3/m^2.24$ hr.1 atm.

The modified atmosphere package can have a water barrier in the walls of the package. The water barrier can be a polymeric film in the walls of the package. The water barrier can be a polymeric film inner liner which is water repellent. The water barrier property can be achieved by a combination of a polymeric film and a highly sized inner surface. The sizing can be a suitable waterproof coating on the inner surface.

The horticultural product can be cut flowers. The cut flowers can be re-hydrated with water, plant treatment solution, polymer gel, moist soil or compost.

The modified atmosphere package can be insulated. The insulation can be polyurethane, polyethylene or polypropylene foam. The insulation can be a metal coated polymer film, or a heat reflecting metal film.

The invention is also directed to a corrugated paperboard modified atmosphere package container suitable for packaging cut flowers under refrigerated modified atmosphere conditions comprising: (a) a container constructed of an erected corrugated paperboard blank having flaps, side panels, end panels, base panels and a lid panel which is hinged to one of the side panels, said corrugated paperboard blank having a first layer of Kraft tissue paper of 26 lb. tissue; a second layer of gas permeable, liquid waterproof polymer film adjacent the first layer of 26 lb. tissue; a third layer of 42 lb. Kraft paper adjacent the second layer of polymer film, on a side opposite the first layer of 26 lb. tissue; a fourth layer of corrugated fluting adjoining the side of the third layer of 42 lb. tissue opposite the side adjacent the second layer of polymer film; and a fifth layer of Kraft paper affixed to a side of the fourth layer of corrugated fluting opposite the third layer of 42 lb. Kraft paper layer.

The first layer tissue can be highly sized with a waterproof surface coating to provide high water repellency.

The second polymer film layer can have a gas permeability which can permit oxygen and carbon dioxide to be transmitted in either direction through the polymer film at prescribed levels, said second polymer film layer being waterproof and preventing liquid water from being transmitted through the polymer film.

The package container can be opened to provide an opening and expose the cut flowers in the opening, the stems of the cut flowers remaining in the package and being wetted with water to re-hydrate the cut flowers. The package can include a tear tape located around at least a portion of the exterior of the package, the tear tape being removable and enabling the container to be opened to provide an opening and expose the cut flowers.

The package container can include insulation between the fluting and one of the adjoining Kraft paper layers. Insulation capability can be enhanced by a heat reflecting metallic coated polymer film or a metal film.

The package container can include water, plant treatment solution, polymer gel, moist soil or compost in the interior of the container. The package container can include a liner which can hold the water, plant treatment solution, polymer gel, moist soil or compost in place in the interior of the package container. The package container can include a dry gel held in place within the container by a liner. The dry gel can be saturated with water for rehydrating the flowers.

BRIEF DESCRIPTION OF DRAWINGS

In drawings which illustrate specific embodiments of the invention, but which should not be construed as restricting the spirit or scope of the invention in any way:

FIG. 1 illustrates an isometric view of a Bliss type three piece MAP box of an elongated geometric configuration designed for packaging harvested horticultural products and particularly cut flowers.

FIG. 3 illustrates a section view taken along section line a—a of FIG. 1 showing the construction of a top edge seal and the MAP box holding any one of water, re-hydration solution, polymer gel, soil or compost.

FIG. 4 illustrates a section view taken along section line b—b of FIG. 1 showing the construction of water resistant hermetic glue seals at the end panels of the MAP box.

DETAILED DESCRIPTION OF SPECIFIC EMBODIMENTS OF THE INVENTION

Corrugated Paper Box for Horticultural Products

Figure 5:
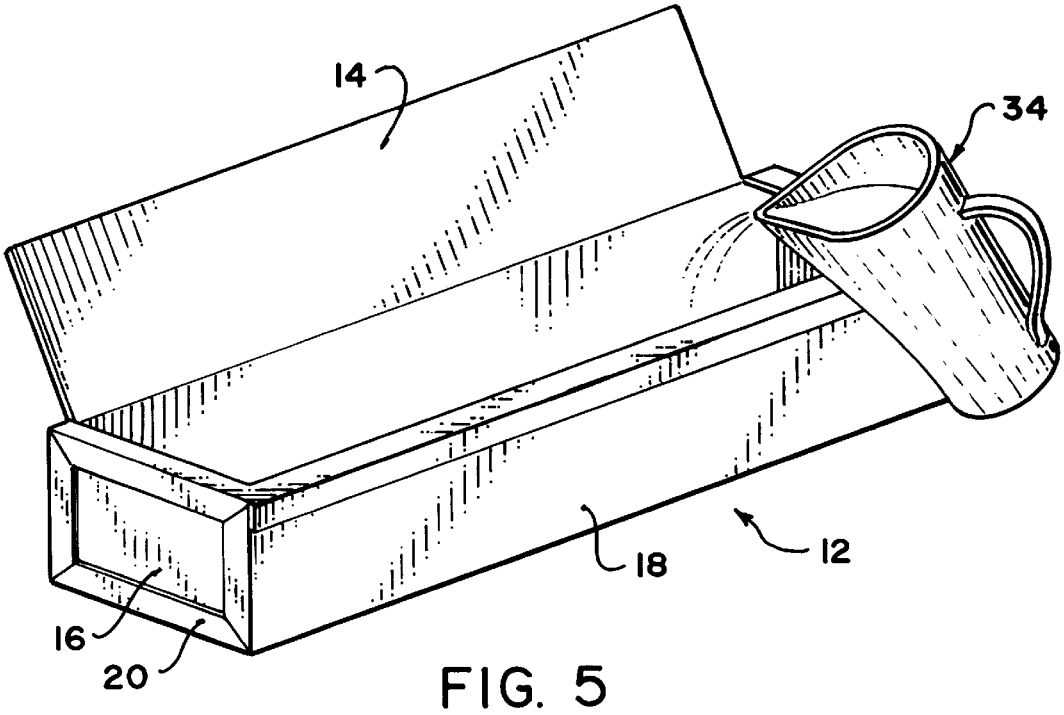
FIG. 5 illustrates an isometric view of the MAP Bliss type box opened at the top to allow the inclusion of water, re-hydration solution, polymer gel, soil or compost into the MAP box.

Referring to the drawings, FIG. 1 illustrates an isometric view of a Bliss type three piece MAP box of an elongated geometric configuration designed for packaging harvested horticultural products and particularly cut flowers. As seen in FIG. 1, the box 12 is constructed with an openable lid 14, with front flap 22, two end plates 16, a front 18, and end flaps 20.

Figure 2:
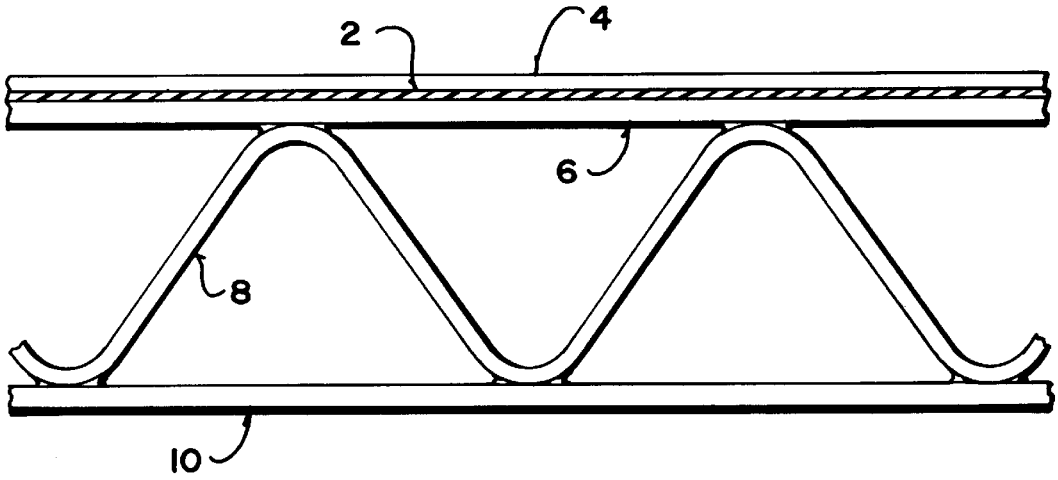
FIG. 2, shown on the same sheet as FIG. 5, illustrates a cross-section view of the paperboard construction of the MAP box, comprising a 3-ply liner, fluting and a paper outer wall.

FIG. 2, shown on the same sheet as FIG. 5, illustrates a cross-section view of the paperboard wall construction for the MAP box 12. The wall construction comprises an inner Kraft paper layer 4, a polymer liner 2, and an intermediate Kraft paper layer 6, which form a 3-ply configuration. A corrugated fluting 8 has the 3-ply liner on one side and an outer Kraft paper layer 10 on the other side. As a general rule, the 3-ply liner 2, 4, 6 is positioned on the inside of the box 12 to provide water repellency to the interior of the box. The surface of the paper layer 4 can be highly sized with a gelatinous material, or some other suitable waterproofing sizing agent, on the interior side to enhance water repellency. Also, the film 2 can be water repellent.

FIG. 3 illustrates a section view taken along section line a—a of FIG. 1 showing the construction of the top lid 14, front flap 22 and front 18 as well as a top edge glue seal 26, sealing tape 28 and the box holding a water medium which can be any one of water, re-hydration solution, polymer gel, soil or compost 24. It will be understood that any suitable water retention medium 24 can be used so long as it fulfills the objectives of the invention. A film or restraining member 25 can be used to hold the water medium 24 in place.

FIG. 4 illustrates a section view taken along section line b—b of FIG. 1 showing the constructions of the top lid 14, two end plates 16 with two end flaps 20. Water resistant hermetic glue seals 29 are made at the upper and lower edges of the end panels 16 to seal the end panels 16 to the lid 14 and other parts of the box 12.

FIG. 5 illustrates an isometric view of the MAP Bliss type box with the lid 14 opened to allow the inclusion of water (depicted by watering pitcher 34), re-hydration solution, polymer gel, soil or compost into the box.

Figure 6:
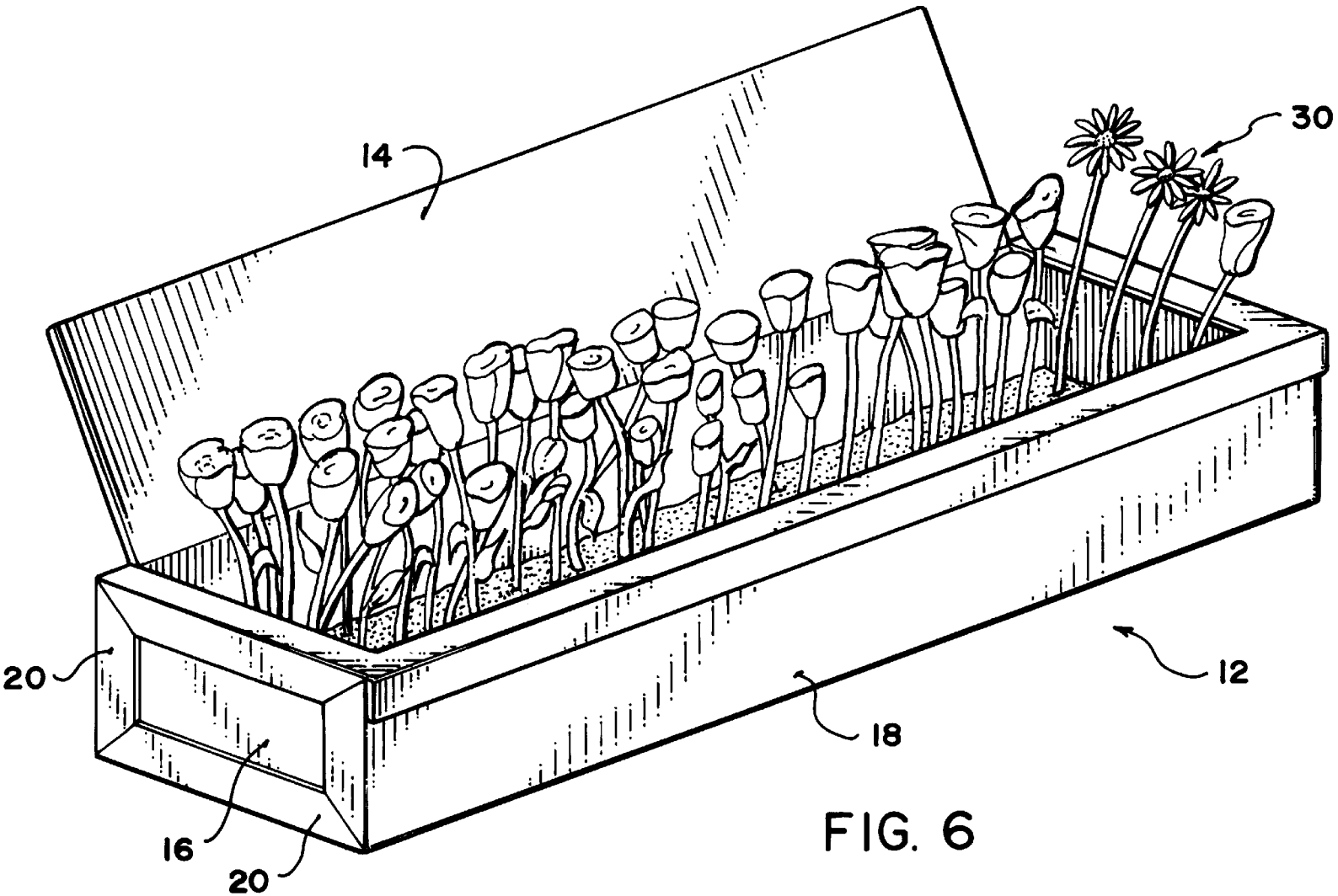
FIG. 6 illustrates an isometric view of the MAP Bliss type box opened at the top and used for both re-hydrating and displaying the cut flowers.

FIG. 6 illustrates an isometric view of the opened MAP Bliss type box when it is used both for re-hydrating and displaying the cut flowers 30. The lid 14 has been raised thereby exposing the flowers 30.

Figure 7:
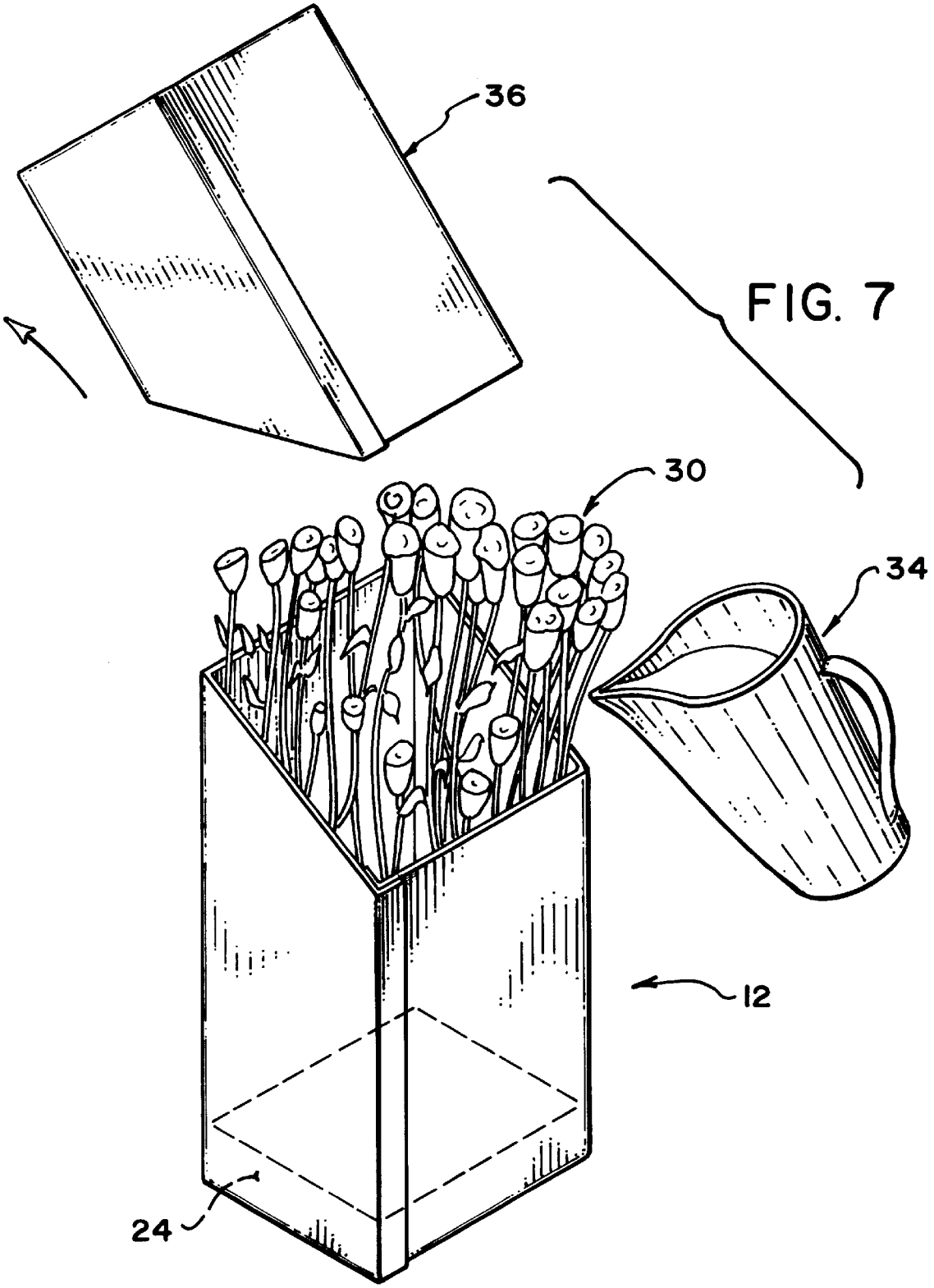
FIG. 7 illustrates an isometric view of the MAP Bliss type box in an erect position with the top half removed to expose the cut flowers for display and allowing the inclusion of water or re-hydration solution into the MAP box.

FIG. 7 illustrates an isometric view of the MAP Bliss type box 12 in an erect position with the top half 36 cut and removed to expose the cut flowers 30 for display and allowing the inclusion into the box 12 of water or re-hydration solution by the pitcher 34. In this case, the box 12 is cut by a suitable paperboard cutting knife rather than opening the lid 14.

Figure 8:
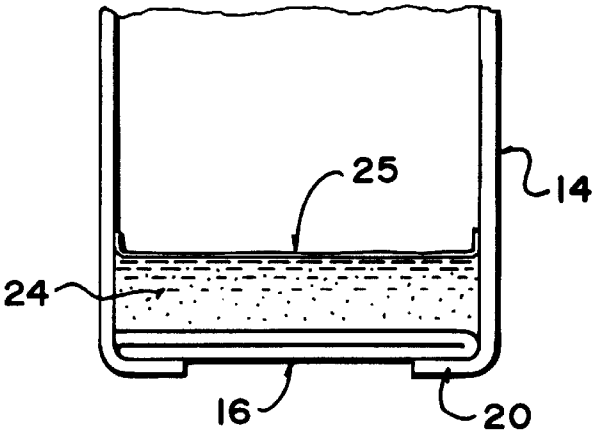
FIG. 8 illustrates a section view of the end of a MAP Bliss type box with a polymer gel and a holding film at one end.

FIG. 8 illustrates a section view of the end of a MAP Bliss type box with a polymer gel and a holding film at one end. The gel 24 is held in place at the end of the box adjacent end plate 16 by a film 25. Other suitable holding mechanisms such as bags or netting can be used rather than film 25.

Figure 9:
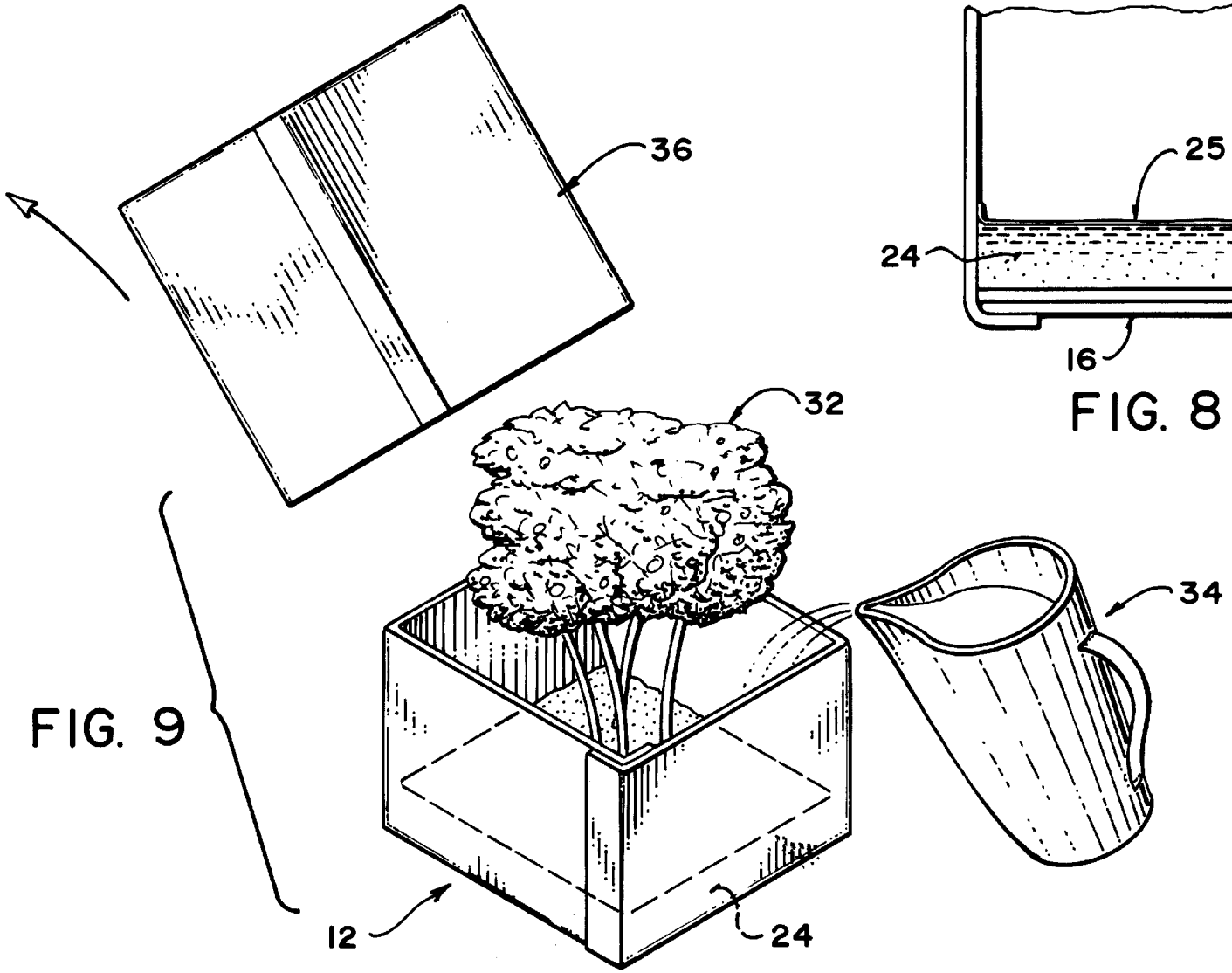
FIG. 9 illustrates an isometric view of the MAP Bliss type box in an erect position with the top half removed to expose a "potted" plant for display and allowing the inclusion of water or re-hydration solution into the MAP box.

FIG. 9 illustrates an isometric view of the MAP Bliss type box in an erect position with the top half 36 cut away and lifted to expose a "potted" plant 32 for display and allowing the inclusion of water or re-hydration solution 24, depicted by pitcher 34 into the interior of the box. FIG. 24 shows the soil or compost 24 at the bottom, holding the roots of the potted plant 32.

The modified atmosphere corrugated box 12 according to the invention, not only provides a hermetically sealed box with controlled $O_2$ and $CO_2$ transmission rates, but because of the highly sized inner tissue paper and vapour barrier film, it has the ability to hold a liquid such as water or re-hydration solution for several hours without leaking or losing physical strength. The box according to the invention can be used for packaging cut flowers under MAP conditions and re-hydrating the cut flowers 30 (see FIG. 6) or preventing horticulture products such as potted plants 32 (see FIG. 7) from losing water. The box 12 can therefore be used to hold a suitable water type medium such as water 24, re-hydrating solution, polymer gel, soil or compost. The gel 24 can be held in place by a film 25 (see FIG. 8) or in a film bag, or some other suitable retention medium.

The water holding properties of the wall intersections of the box 12 are achieved by a combination of glue seals 26 and 29 (see FIGS. 3 and 4) which prevent leakage around end plates 16 and flaps 20 at the end corners and lid 14 with flap 22 at the top front of the box. The application of self adhesive tape 28 to the inner cut board edges (see FIG. 3) prevents side wicking. The moisture repellence characteristics of the highly sized inner surface paper 4, plus the moisture and liquid barrier properties of the polymer lining 2 (see FIG. 2), prevent water and moisture from penetrating to the intermediate paper layer 6 and the fluting 8 of the basic wall sections, thereby weakening the strength of the box 12.

The water holding and strength retention properties of the box 12 are particularly appropriate to the flower and horticulture products industry where it is common for the shipped closed boxes containing the flowers, plants or horticultural products to be opened and the flowers or plant to be re-hydrated either at an auction room, distribution centre or retail outlet. The current practice at an auction room distribution centre or retail outlet is to remove the flowers, sort and grade the flowers, re-bunch them, and then place them in buckets containing water or a treatment solution for the final few hours prior to sale of the flowers. In some cases, the flowers are of a variety where the ends of the stems suffer necrosis and cell collapse and have to be recut before placing them in a bucket or container. This is a cumbersome, labour intensive, time-consuming operation requiring a large amount of labour and numerous buckets, all of which increase the overall expense. The ability, in one operation, to convert the modified atmosphere box 12 holding dry flowers 30 to a wet pack for rehydration and display of the flowers 30 provides a major cost saving in the flower distribution industry. It means the one box can not only protect the flowers throughout the distribution chain, from grower to retailer, but the box itself upon opening can be used for rehydration and display. Accordingly, less labour and fewer extraneous support materials are required.

Flowers are most commonly packed in elongated boxes to suit the length of the stem whereas plants are packed in more compact cube shaped boxes. For either shape, this invention provides an openable box either by opening the top panel 14 (see FIG. 5), the side panel or the end panel 16 of the box 12 to expose the horticultural contents and allow the inclusion of the water or treatment solution into the interior of the box 12. (See FIGS. 5, 6, 7 and 9.) Water or treatment solution is added in sufficient quantity to ensure that the cut ends of the flower stems or plant roots are fully immersed in the water or solution. Once the cut flowers or the plant are rehydrated with the water or solution, the open top box then automatically becomes a "bucket" for displaying the cut flower or plant.

To ensure moisture resistance and structural strength for the box 12, it is essential to have a highly sized Kraft paper 4 on the internal surface of the box 12 (see FIG. 2). Otherwise, the paper tissue of Kraft layer 4 will absorb the liquid and weaken. This can enable the liquid by capillary action to penetrate behind the glue seals 26 on the top flap 22, and the glue seals 29 on the end flaps 20 and pass behind the waterproof polymer layer 2. The water can then contact the fluting medium 8 in the interior of the paperboard (see FIG. 2) and reduce the strength of the fluting 8 and the overall box 12 further. In such cases, the box 12 will lose its physical strength and eventually collapse.

When flowers and horticulture products are retained inside the sealed modified atmosphere box 12, they are discouraged from drying out (de-hydrating) by the high moisture barrier properties of the polymer liner 2 in the paperboard (see FIG. 2). This allows the cut ends of the stems of the cut flowers to retain moisture and as a result most varieties of flowers do not need cutting back once the box 12 is opened. This is a very important advantage because it greatly reduces flower handling time. As the value of most flowers is very much dependent on the stem length, and long stems are favoured, any process which avoids the need to eliminate this stem cutting process significantly increases the value of the flower. Reducing labour cost is also an important feature of the process of the invention.

The invention also includes applications where the MAP properties of the box may be combined with the liquid retaining capability (see FIG. 3 and liquid retaining medium 24) to provide a box where the liquid can be transported within the closed box 12 through part or all of the distribution chain from the producer to the end user. The liquid medium 24 can be water held in place in the end of the box 12, or the bottom of the box 12, by a retainer liner 25, or some dimensionally stable water holding medium such as polymer gel, soil or compost. A liner 25 can also be used to hold the polymer gel 24, soil or compost in place. The liner 25 can be a polymer film secured by adhesive to the sides of the box 12 to provide a waterproof compartment, which can be opened or punctured as needed. The liner 25 can be a bag fastened inside the box 12. In the case of soil or compost, the liner can be perforated to permit moisture to pass.

The invention therefore includes embodiments where the water, re-hydration solution, polymer gel, soil or compost 24 is freely distributed within either the sealed or open box 12, and where the water, re-hydration solution, polymer gel, soil or compost 24 is retained in a specific compartment inside the box, typically in a waterproof bag or behind a board or polymer divider or liner 25. As seen in FIG. 3, the liner 25 would separate the water 24, or other medium, from the interior space in the box 12. FIG. 8 illustrates a dry gel 24 held in place at the end of the box by a film 25. The gel 24 at some stage would be soaked with water.

Corrugated Paperboard Box with Insulation Layer

Chill or refrigeration distribution chains currently used in commerce for fresh fruit and vegetable produce and cut flowers usually do not provide adequate temperature control to ensure optimum shelf life for the produce. Pallets and/or boxes can be stored in hot areas and be subject to unacceptable temperature rise thereby causing the contents to increase their respiration rate, which in turn leads to a shortening of the life of the produce or cut flowers, both in terms of microbiological activity and sensory quality. Furthermore, when the box is subjected to a rise in temperature, the gas permeability rate of the polymer lining increases and therefore allows higher levels of oxygen into the box. This promotes more rapid decay of the fresh produce or cut flowers.

To offset these problems, there is a need in the industry for a box that will not only protect the MA packaged produce by controlling gas transmission rate through the walls of the box, but also providing a high level of resistance to heat penetration. This can be done by putting insulation into the MAP. It is important, however, that the insulation substance that is used does not alter the overall gas transmission rate of the barrier liner or the other components of the walls of the box. Flowers generally have low respiration rates so the natural build up of heat inside the box is minimal. However, the box is more likely to pick up heat from the surrounding conditions. The need to provide insulation is particularly important where commodities are air freighted since the aircraft and airport apron handling operations are usually performed at ambient temperatures, which may be hot or cold, and are rarely temperature controlled. Air carriers typically fly at altitudes of 30,000 or 40,000 feet where temperatures are typically −40 to −60° C. In tropical and semi-tropical parts of the world, it is common for loaded pallets to sit on a tarmac for hours waiting for the aircraft to be loaded.

A further embodiment of this invention is the inclusion of a thermal insulating substance adjacent the fluting medium of the corrugated paperboard sheet. The insulating substance is applied on the corrugating line after the single facer station and before the double backer station. After the single facer station, the fluting is exposed which allows the sheet to pass through a coating station where the insulation substance can be applied. The insulation substance is applied to the voids created by successive curves of the fluting. The coated single faced sheet can then pass to the double backer station for the barrier liner to be applied in the normal manner. When the barrier liner is applied at the double backer station, it seals the insulating substance on one side of the fluting.

The insulating substance can be a foamed polymer such as foamed in place polyurethane, polyethylene or polypropylene. The foamed polymer may be chosen to enhance the final gas and moisture barrier properties of the corrugated sheet. Alternatively, it may be selected so as not to change the barrier properties. Finally, it may be selected to completely replace the barrier in the liner. The foamed structure can also be used for the purpose of adding strength to the corrugated sheet.

An alternative method of providing thermal insulation is to use a highly reflective material laminated or coated onto either surface of the box. Such materials can typically be metallized ink, metallized polymer films such as polyester, polypropylene or polyethylene, or aluminum foil. In certain applications, gas barrier effect may also be achieved by using a metallized film in place of the extrusion laminated polymer. Metallized films are produced by the vacuum deposition of fine particles of aluminum onto the film surface. It is known that the gas barrier can be controlled by using different coating weights. A further factor is the smoothness of the polymer surface. For example, a polyester film has a comparatively smooth surface and provides a better gas barrier than polyethylene which has a comparatively a rough surface. For fresh produce with a high respiration rate requiring maximum gas transmission rate, a low coating weight of metal on polyethylene can be used. For a low respiring product, such as flowers, a high metal coating weight on polyester can be used. The fundamental principle of this embodiment is to reflect heat away from the box and retain proper chill temperatures inside the box.

Whatever insulation medium is selected, it is an important requirement for the coated sheet that it retain its ready cutting and creasing properties. Coating the corrugated fluting on only one side of the sheet enables the sheet to retain sufficient flexibility to withstand the creasing process during the box cutting, folding and erection operations.

The degree of insulation provided by the foamed polymer depends on the final density of the coating, the coating thickness, the chemical composition of the polymer and the thermal conductivity coefficient of the polymer.

Figure 10:
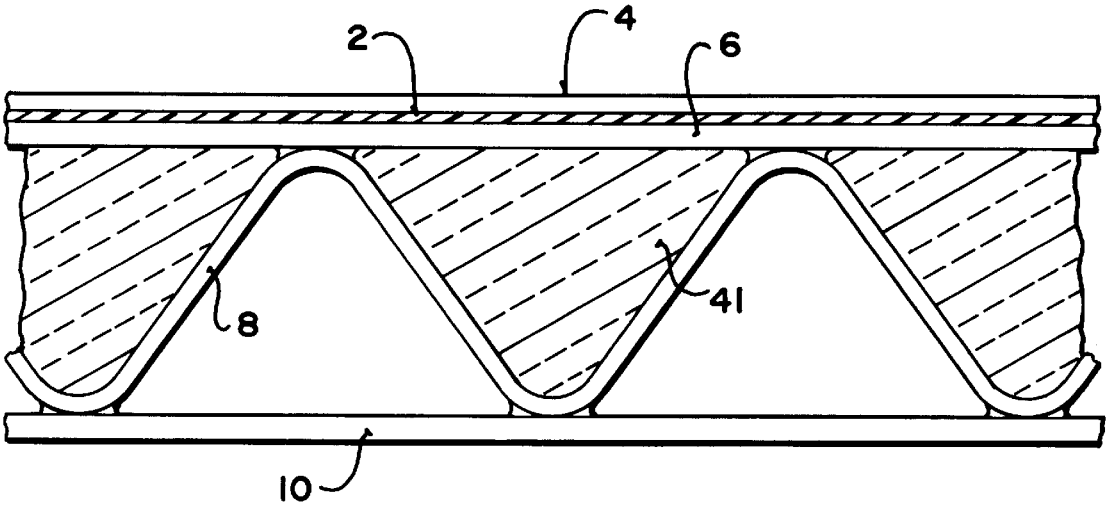
FIG. 10 illustrates a cross-section view of a corrugated MAP paperboard with an inner liner comprising a polymer layer sandwiched between two layers of Kraft paper, a foamed polymer sandwiched between the 3-ply inner liner and the fluting, corrugated fluting and a Kraft paper outer wall.

Referring to the drawings, FIG. 10 illustrates a section view of a corrugated MAP insulated paperboard with an inner highly sized Kraft water resistant paper layer 4, a water resistant polymer film 2 and an intermediate layer of Kraft paper 6 to provide a 3-ply structure. A foamed polymer 41 is sandwiched between one side of the corrugated fluting 8 and the intermediate ply of Kraft paper 6. An outer layer of Kraft paper 10 is located on the side of the fluting 8 opposite the 3-ply layer 2, 4 and 6 and the insulation 41. The foamed polymer 41 acts as an insulating layer to protect the contents of the box from temperature abuse. It can also be used to add additional gas barrier properties to the overall box structure.

Figure 11:
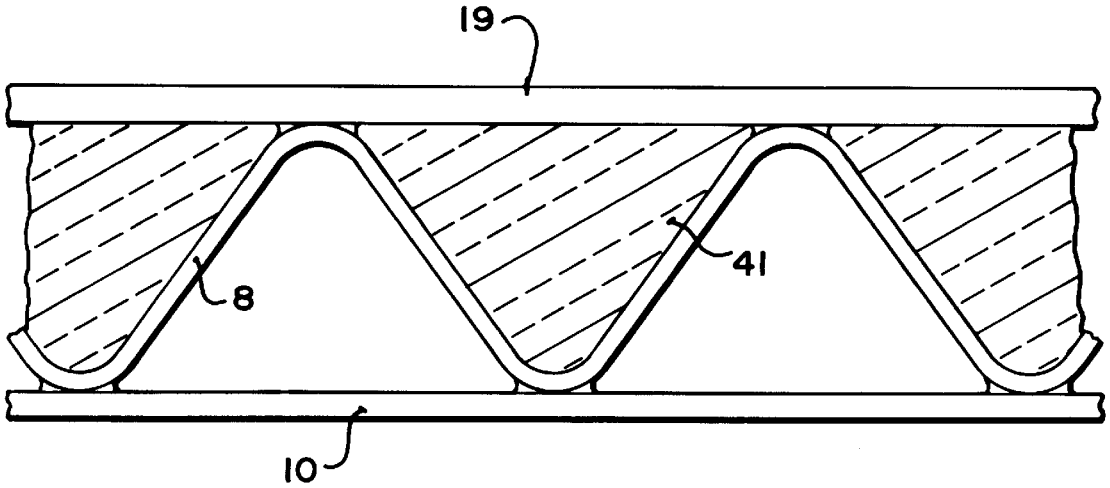
FIG. 11 illustrates a cross-section view of a corrugated MAP paperboard with a Kraft paper inner wall, a foamed polymer sandwiched between the inner wall and the fluting, a corrugated fluting, and a Kraft paper outer wall.

FIG. 11 illustrates a section view of an alternative embodiment of a corrugated MAP insulated paperboard with a single thick Kraft layer of paper 19 on one side, a foamed polymer 41 on one side of a corrugated fluting 8, and a Kraft layer of paper 10 on the opposite side. For some applications, the foamed polymer 41, without the liner 2, serves as the component providing the gas barrier properties, This eliminates the need for the 3-ply barrier liner 2, 4 and 6 as shown in FIG. 10.

Figure 12:
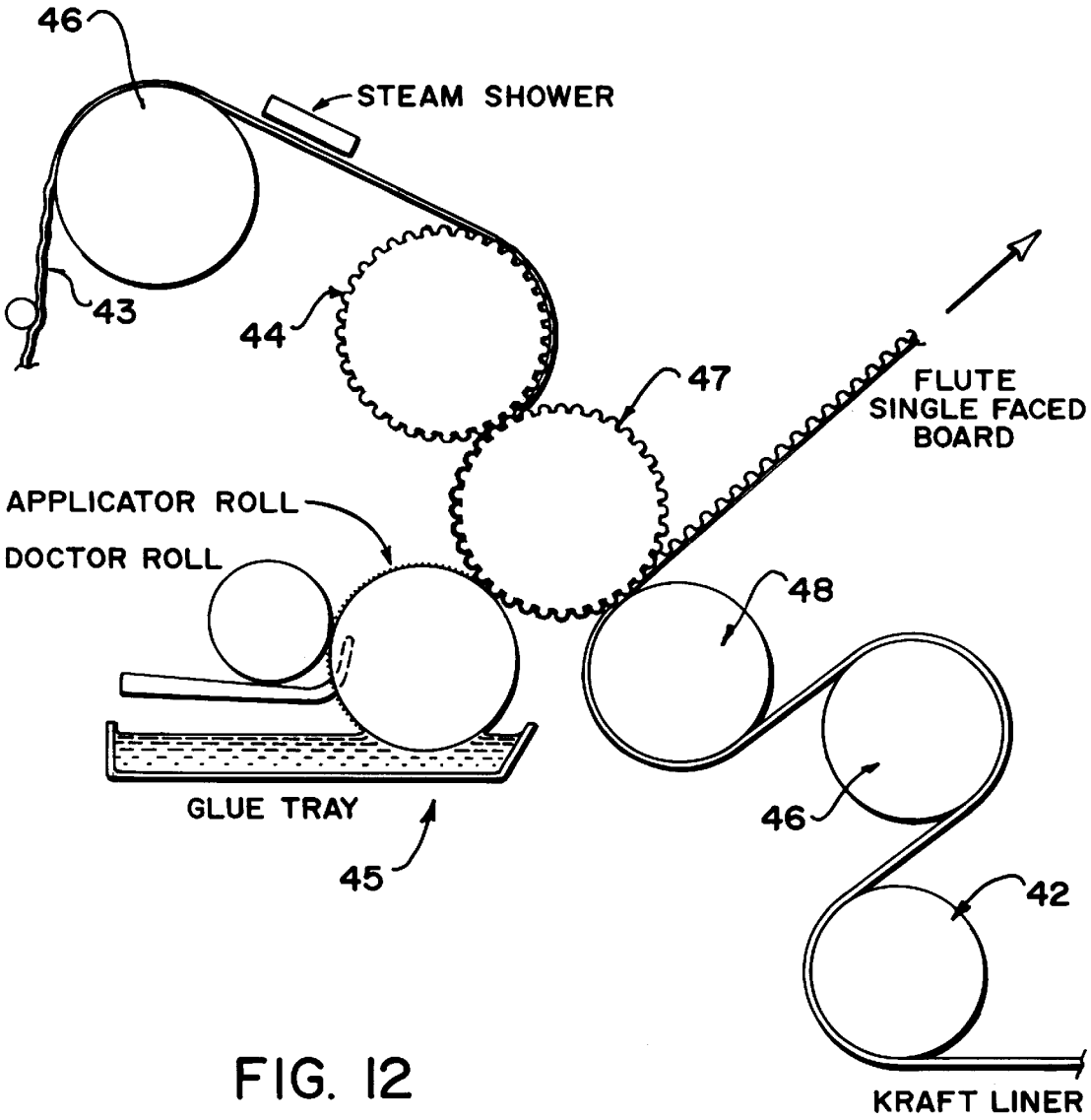
FIG. 12 illustrates a schematic side view of a typical installation for manufacturing a single faced corrugated sheet incorporating a Kraft liner feed roll, a fluting feed roll, a corrugating roller, an adhesive application station, pre-heaters and a pressure roller.

The application of the insulation foam to the paperboard can be carried out on a modified paperboard corrugating line. FIG. 12 illustrates a schematic of the layout of a conventional single faced corrugating line comprising a Kraft liner feed roll 42, a fluting feed roll 43, an upper corrugating roller 44, an adhesive application station 45, pre-heaters 46, a lower corrugating roller 47 and a pressure roll 48. The single faced corrugated sheet typically passes to an overhead bridging section which acts as a buffer for the web prior to it being fed to a double backer station.

Figure 14:
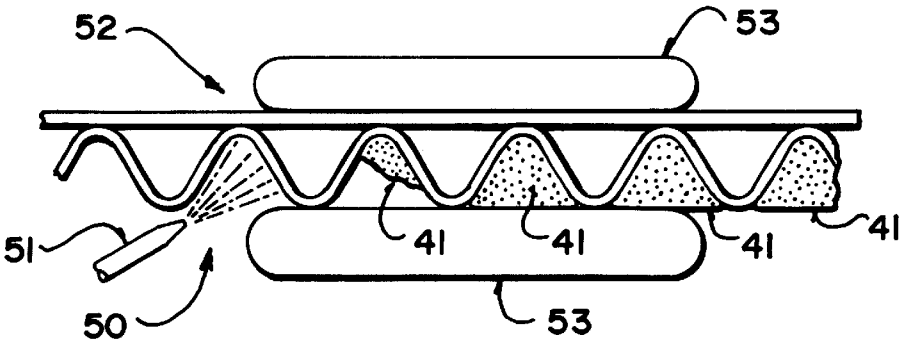
FIG. 14 illustrates an enlarged detail view of the insulation spray station of the production line of FIG. 13.
Figure 13:
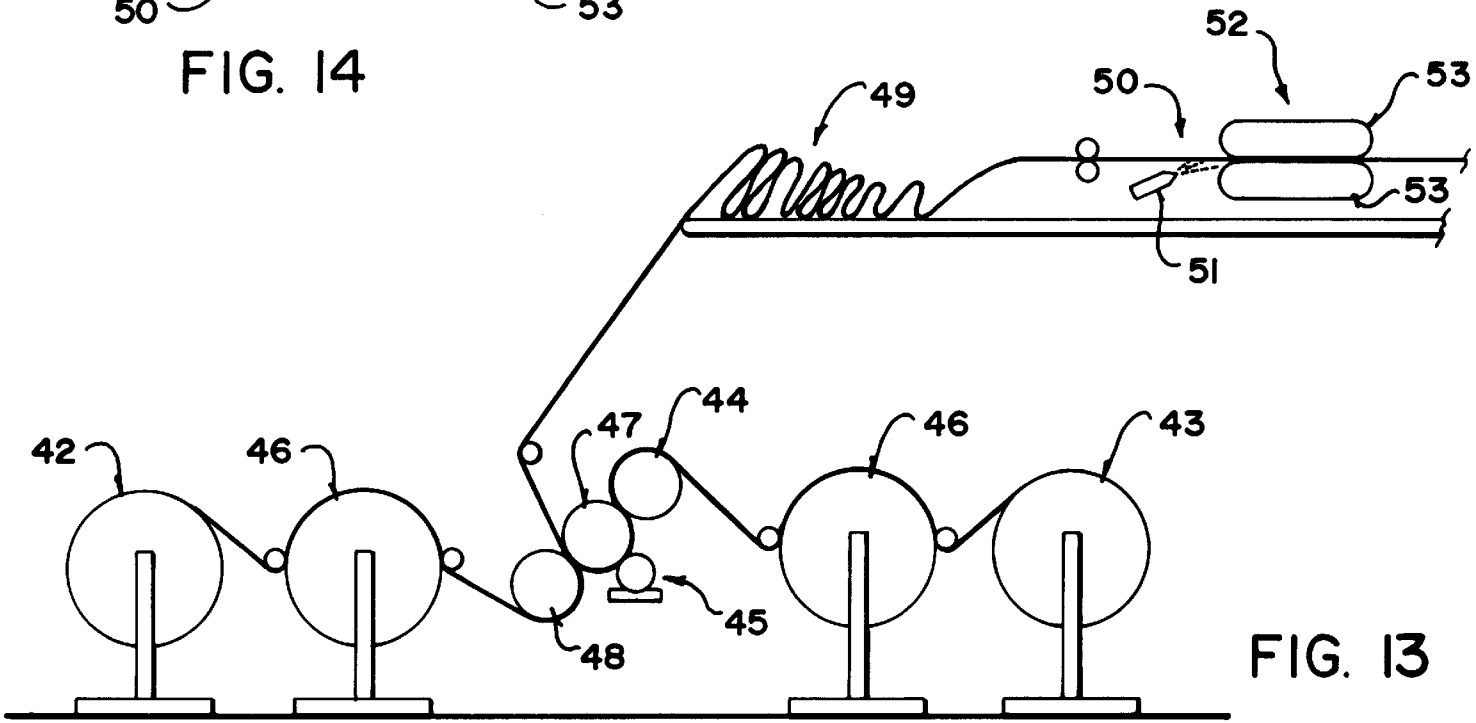
FIG. 13 illustrates a schematic side view of a typical installation for manufacturing single faced corrugated sheet incorporating feed roll stands, pre-heater drums, corrugating station and elevated bridge with a foam insulation application station.

FIG. 13 illustrates a schematic of the buffer station 49 with the addition of a foam application station 50. FIG. 14 illustrates an enlarged view of the foam spraying station 120 shown generally in FIG. 13. The insulation foam 41 can be applied by spray nozzle 51 located on the under side of the paper web before it enters the expansion and compression zone 52 where the polymer expands and sets. Upper and lower pressure plates 53 support the paper web to control the expansion of the polymer and control the gauge of the sheet. The sheet then passes to a double backer station where the barrier liner 2 is applied.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A corrugated paperboard modified atmosphere package container suitable for packaging cut flowers under refrigerated modified atmosphere conditions comprising:

(a) a container constructed of an erected corrugated paperboard blank having flaps, side panels, end panels, base panels and a lid panel which is hinged to one of the side panels, said corrugated paperboard blank having five layers comprising a first layer of sized Kraft tissue paper of 26 lb. tissue; a second layer of gas permeable, liquid waterproof polymer film adjacent the first layer of 26 lb. tissue having a gas permeability which permits oxygen and carbon dioxide to be transmitted in either direction through the polymer film at prescribed levels, said second layer of polymer film being waterproof and preventing liquid water from being transmitted through the film; a third layer of 42 lb. Kraft paper adjacent the second layer of polymer film, on the side opposite the first layer of 26 lb. tissue; a fourth layer of corrugated fluting adjoining the side of the third layer of 42 lb. tissue opposite the side adjacent the second layer of polymer film; and a fifth layer of Kraft paper affixed to a side of the fourth layer of corrugated fluting opposite the third layer of 42 lb. Kraft paper layer, said container including an opening for exposing the cut flowers, and said package including a tear tape located around at least a portion of the exterior of the package, said tear tape being removable and enabling the container to be opened to provide an opening and expose the horticultural product.

2. A package container as claimed in claim 1 wherein the container includes insulation between the fluting and one of the adjoining Kraft paper layers.

3. A package container as claimed in claim 1 including water, plant treatment solution, polymer gel, moist soil or compost in the interior of the container.

4. A package container as claimed in claim 1 including a liner which holds the water, plant treatment solution, polymer gel, moist soil or compost in place in the interior of the package container.

5. A package container as claimed in claim 1 including a gel and a retaining liner.

6. A method of transporting horticultural products from a first location to a second location characterized by:

(a) constructing a waterproof package having walls with a gas permeability between about 50 and about 50,000 $cc^3/m^2$. 24 hr. 1 atm. and a water barrier in the walls;

(b) packaging the horticultural product in the waterproof package and incorporating a carbon dioxide and oxygen modified atmosphere in the package at a first location;

(c) transporting the modified atmosphere packaged horticultural product from the first location to a second location; and (d) opening the package of the horticultural product at the second location and hydrating the horticultural product.

7. A method as claimed in claim 1 comprising constructing the water barrier of a water repellent polymeric film.

8. A method as claimed in claim 1 comprising constructing the water barrier of a combination of highly sized interlayer and a polymeric layer.

9. A method as claimed in claim 1 comprising packaging cut flowers as the horticultural product in the waterproof package.

10. A method as claimed in claim 1 which comprises hydrating the horticultural product with water, plant treatment solution, polymer gel, moist soil or compost.

11. A method as claimed in claim 9 which comprises hydrating the horticultural product with water, plant treatment solution, polymer gel, moist soil or compost.

12. A method as claimed in claim 1 including incorporating insulation in the walls of the modified atmosphere package.

13. A method as claimed in claim 1 including incorporating polyurethane, polyethylene or polypropylene foam as insulation in the walls of the package.

14. A method as claimed in claim 12 including incorporating metal coated polymer film as insulation in the walls of the package.

* * * * *